US008067142B2

(12) United States Patent
Halfyard et al.

(10) Patent No.: US 8,067,142 B2
(45) **Date of Patent: *Nov. 29, 2011**

(54) COATING, SYSTEM AND METHOD FOR CONDITIONING PRINTS

(75) Inventors: Kurt I. Halfyard, Mississauga (CA); Christine D. Anderson, Hamilton (CA); Edward Zwartz, Mississauga (CA); T. Brian McAneney, Burlington (CA)

(73) Assignee: Xerox Corporation, Norwalk, CT (US)

( * ) Notice: Subject to any disclaimer, the term of this patent is extended or adjusted under 35 U.S.C. 154(b) by 903 days.

This patent is subject to a terminal disclaimer.

(21) Appl. No.: 12/004,161

(22) Filed: Dec. 20, 2007

(65) Prior Publication Data

US 2009/0162555 A1 Jun. 25, 2009

(51) Int. Cl.
*G03G 5/00* (2006.01)

(52) U.S. Cl. ..... 430/124.13; 430/126.1

(58) Field of Classification Search ..... 430/124.13, 430/126.1

See application file for complete search history.

(56) References Cited

U.S. PATENT DOCUMENTS

| | | | | |
|---|---|---|---|---|
| 4,070,262 | A | 1/1978 | Guarino et al. | 204/159.24 |
| 4,071,425 | A | 1/1978 | Guarino et al. | 204/159.24 |
| 4,072,592 | A | 2/1978 | Dué et al. | 204/159.15 |
| 4,072,770 | A | 2/1978 | Ting | 427/54 |
| 4,133,909 | A | 1/1979 | Spencer | 427/54 |
| 4,231,593 | A | 11/1980 | Bell, Jr. et al. | 283/6 |
| 4,265,976 | A | 5/1981 | Nowak | 428/486 |
| 4,265,990 | A | 5/1981 | Stolka et al. | 430/59 |
| 4,343,243 | A | 8/1982 | Gentry et al. | 101/96 |
| 4,558,108 | A | 12/1985 | Alexandru et al. | 526/340 |
| 4,563,408 | A | 1/1986 | Lin et al. | 430/59 |
| 4,584,253 | A | 4/1986 | Lin et al. | 430/59 |
| 4,585,884 | A | 4/1986 | Lin et al. | 556/413 |
| 4,634,148 | A | 1/1987 | Greene | 283/70 |
| 4,688,050 | A | 8/1987 | Tsao | 346/76 |
| 4,891,240 | A | 1/1990 | Ward et al. | 427/11 |
| 5,084,359 | A | 1/1992 | Talvalkar et al. | 428/484 |
| 5,089,350 | A | 2/1992 | Talvalkar et al. | 428/484 |
| 5,135,569 | A | 8/1992 | Mathias | 106/22 |
| 5,162,389 | A | 11/1992 | Lee et al. | 522/42 |
| 5,219,641 | A | 6/1993 | Mehta et al. | 428/211 |
| 5,223,368 | A | 6/1993 | Ciccarelli et al. | 430/110 |
| 5,346,795 | A | 9/1994 | Pickering et al. | 430/110 |

(Continued)

FOREIGN PATENT DOCUMENTS

WO WO 01/84247 11/2001

OTHER PUBLICATIONS

EPO Search Report for European Patent Application No. 08172219.1.

*Primary Examiner* — Mark Chapman
(74) *Attorney, Agent, or Firm* — Alix, Yale & Ristas, LLP

(57) ABSTRACT

Disclosed herein is a xerographic print comprising a substrate having a printed image thereon comprising a low melt temperature toner, and a polyolefin wax coating formed over the printed image having a dry thickness in the range of about 0.5 to about 5 microns. The wax coating substantially prevents toner offset at temperatures up to at least 70° C. A printing system and coating method also are disclosed. The prints, printing system and method are useful for making brochures and books that will be subjected to high temperatures, pressures, and/or humidity levels, such as manuals stored in automobile glove compartments.

20 Claims, 5 Drawing Sheets

U.S. PATENT DOCUMENTS 5,366,840 A 11/1994 Larson et al. ..... 430/115
5,456,498 A 10/1995 Greene ..... 283/70
5,514,467 A 5/1996 Berkes et al. ..... 428/329
5,525,572 A 6/1996 Williams ..... 503/201
5,554,480 A 9/1996 Patel et al. ..... 430/137
5,556,727 A 9/1996 Ciccarelli et al. ..... 430/45
5,627,002 A 5/1997 Pan et al. ..... 430/115
5,639,708 A 6/1997 Golemo et al. ..... 503/205
5,759,734 A 6/1998 Malhotra ..... 430/124
5,800,884 A 9/1998 D'Anna et al. ..... 428/35.7
5,826,147 A 10/1998 Liu et al. ..... 399/237
5,843,579 A 12/1998 Roth et al. ..... 428/484
5,866,637 A 2/1999 Lorenz ..... 523/161
5,888,622 A 3/1999 Pinell et al. ..... 428/195
5,966,570 A 10/1999 Till et al. ..... 399/133
6,032,004 A 2/2000 Mirabella, Jr. et al. ..... 399/90
6,155,604 A 12/2000 Greene et al. ..... 283/70
6,180,308 B1 1/2001 Pan et al. ..... 430/115
6,187,499 B1 2/2001 Zhao et al. ..... 430/119
6,212,347 B1 4/2001 Zhao et al. ..... 399/237
6,291,121 B1 9/2001 Hollenbaugh, Jr. et al. ..... 430/108.7
6,326,119 B1 12/2001 Hollenbaugh, Jr. et al. ..... 430/137.2
6,365,316 B1 4/2002 Stamp et al. ..... 430/111.41
6,530,601 B2 3/2003 Greene ..... 283/57
6,613,403 B2 9/2003 Tan et al. ..... 428/29
6,673,500 B1 1/2004 Patel et al. ..... 430/108.2
6,701,304 B2 3/2004 Leon ..... 705/401
6,743,561 B2 6/2004 Heeks et al. ..... 430/124
6,782,144 B2 8/2004 Bellavita et al. ..... 382/310
6,824,942 B2 11/2004 Silence et al. ..... 430/108.4
6,850,725 B2 2/2005 Silence et al. ..... 399/297
6,970,246 B2 11/2005 Hansen ..... 356/417
7,058,350 B2 6/2006 Hsieh et al. ..... 399/380
7,166,406 B2 1/2007 McAneney et al. ..... 430/124
2004/0137203 A1 7/2004 Adams et al. ..... 428/195.1
2005/0249895 A1 11/2005 Sisler et al. ..... 428/32.34
2005/0250038 A1 11/2005 McAneney et al. ..... 430/124
2005/0250039 A1 11/2005 Halfyard et al. ..... 430/124
2005/0285918 A1 12/2005 McElligott et al. ..... 347/101
2006/0046043 A1 3/2006 Tani
2006/0118738 A1 6/2006 Ross et al. ..... 250/556
2006/0118739 A1 6/2006 Ross et al. ..... 250/556
2006/0186348 A1 8/2006 Nguyen et al. ..... 250/484.4
2007/0021522 A1 1/2007 Halfyard et al. ..... 522/18
2007/0095921 A1 5/2007 Roth ..... 235/491
2007/0108392 A1 5/2007 Ross ..... 250/458.1
2007/0120922 A1 5/2007 Belelie et al.

COATING, SYSTEM AND METHOD FOR CONDITIONING PRINTS

BACKGROUND

The embodiments disclosed herein generally relate to coated xerographic prints. The coated prints have toner-based image stability under conditions of high temperature, humidity and/or pressure.

In conventional xerography, electrostatic latent images are formed on a xerographic surface by uniformly charging a charge retentive surface, such as a photoreceptor. The charged area is then selectively dissipated in a pattern of activating radiation corresponding to the original image. The latent charge pattern remaining on the surface corresponds to the area not exposed by radiation. Next, the latent charge pattern is visualized by passing the photoreceptor past one or more developer housings comprising toner, which adheres to the charge pattern by electrostatic attraction. The developed image is then fixed to the imaging surface or is transferred to a receiving substrate, such as paper, to which it is fixed by a suitable fusing technique, resulting in a xerographic print or toner-based print.

Although xerographic equipment is used worldwide, it possesses a significant disadvantage in that in some cases the energy consumption is quite high. Thus, equipment with lower power consumption has been designed. Toners that function in the lower power consumption equipment, known as "low-melt toners," are designed to have low glass transition temperatures ($T_g$'s) of about 55° C. to about 65° C. However, an image defect known as document offset (or "blocking") can occur at temperatures as low as about 54° C. to as high as about 70° C. or more, which is when the toner begins to melt. Thus, low-melt toners often have a significant document offset problem. The onset of document offset for various toners is set forth in Table 1.

TABLE 1

Comparison of Onset Temperatures for Document Offset for Various Low-Melt Toners

| Toner | Machine | Temperature* |
|---|---|---|
| FC II | DC2060 & DC12 | 62° C. (144° F.) |
| FC I | DC40 & Majestik .RTM. (Xerox Corp.) | 61° C. (142° F.) |
| 5090 | DT180 | 55.5° C. (132° F.) |
| C6 & M4 | iGen3 .RTM. (Xerox Corp.) | 55.5° C. (132° F.) |

*where Document Offset (DO) = 4.0 @ 10 g/cm.sup.2

At document offset-provoking temperatures, when combined with pressure, such as several reams of paper in an output tray of a printer, some toner will stick to the sheet above it, or, in the case of duplex printing, the toner on the sheet above it. This yields two sheets that have to be pulled apart. In the worse case scenario, the toner pulls off part of the image on or paper fibers from the sheet above it. Clearly, this results in a loss of quality of the toner-based print (also referred to as a toner-based image, xerographic print, or xerographic image).

Known methods of reducing document offset include adding wax to the toner and applying an overprint coating to the substrate. The overprint coating, often referred to as an overprint varnish or composition, is typically a liquid film coating that may be dried and/or cured. Curing may be accomplished through drying or heating or by applying ultraviolet light or low voltage electron beams to polymerize (crosslink) the components of the overcoat. Overprint coatings are described in U.S. Pat. Nos. 4,070,262, 4,071,425, 4,072,592, 4,072,770, 4,133,909, 5,162,389, 5,800,884, 4,265,976, 5,219,641, and 7,166,406, and U.S. Patent Publication Nos. 2005/0250038, 2005/0250039 and 2007/0021522.

It would be useful to develop further systems and methods for treating xerographic prints to provide for stability under conditions of high heat and/or high humidity.

SUMMARY

One embodiment is a xerographic print comprising a substrate having a printed image thereon comprising a low melt temperature toner. A polyolefin wax coating is formed over the printed image. The wax coating has a dry thickness in the range of about 0.5 to about 5 microns and substantially prevents toner offset at temperatures up to at least 50° C. at up to at least 50% relative humidity.

Another embodiment is a printing system comprising a printer, a coater and a drying station. The printer is configured to print a low melt temperature toner-based image on a substrate, and includes a fuser. The coater is disposed downstream from the fuser and is configured to deposit a wax coating having a dried thickness in the range of about 0.5-5 microns onto the toner-based image. The wax coating substantially prevents toner offset of the image at temperatures up to at least 50° C. at up to 50% relative humidity. The drying station is configured to dry the wax coating.

A further embodiment is a method comprising printing an image comprising a low melt temperature toner on a substrate, coating the printed image with a wax coating having a thickness of about 0.5 to 5 microns, the coating substantially preventing toner offset of the printed image at temperatures up to at least 50° C. at up to at least 50% relative humidity, and drying the wax coating. In some cases the coating substantially prevents toner offset at temperatures up to at least 70° C. at up to at least 50% relative humidity.

DETAILED DESCRIPTION

Figure 1:
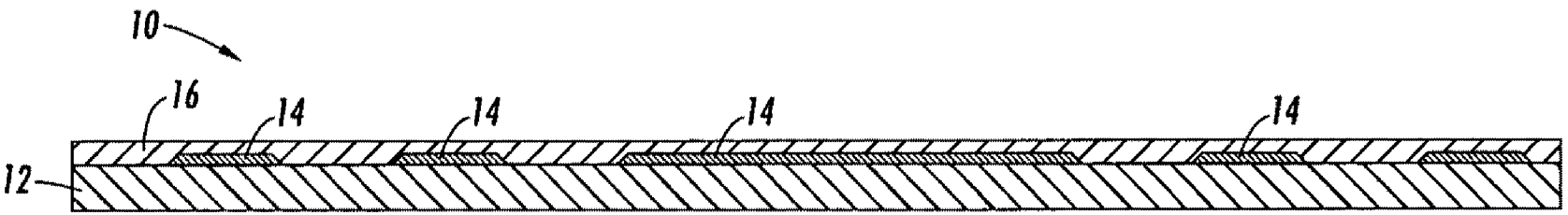
FIG. 1 is a cross sectional view of a document according to one embodiment.

The embodiments described herein are directed to toner-based prints having overcoat compositions, and to systems and methods for overcoating and thus protecting toner-based prints. The coating method uses a wax emulsion applied as a very thin coating, usually but not necessarily by spraying. The overprint compositions reduce toner offset at temperatures up to at least about 50° C. and often at least about 80° C., and thus can be used on prints containing low-melt toners. The coated images exhibit significantly improved document offset, when compared to uncoated toner-based images exposed to high-stress conditions, such as the interior of an automobile in summer.

The overprint composition preferably is applied to the entire surface of a substrate (having a toner-based image thereon). By coating a toner-based print with the wax composition the toner is effectively buried beneath an overcoat, which essentially forms a protective barrier on the print preventing, inter alia, undesirable toner-to-toner and toner-to-substrate interactions.

As used herein, a "wax emulsion" is a dispersion of a wax in a continuous liquid phase. The wax is held in suspension by an emulsifier. A "low melt temperature toner" as used herein is a toner having a bulk glass transition temperature of about 70° C. or less at a relative humidity of up to 50%. A "bulk glass transition temperature" is the glass transition temperature as measured for bulk quantity of a toner before the toner is applied to a substrate. A "surface glass transition temperature" is the glass transition temperature of a toner that is on a particular surface, such as a substrate. The precise glass transition temperature of a toner on a substrate depends upon the particular toner-substrate combination and the relative humidity.

"Toner offset" as used herein refers to the adherence of toner particles to a surface adjacent to the intended print surface. As used herein, a "document" is media having an image printed thereon. The term "collate" as used herein refers to assembling a set of documents in proper numerical sequence. The term "printer" as used herein encompasses any apparatus, such as a digital copier, bookmaking machine, facsimile machine, multi-function machine, etc. that performs a print outputting function for any purpose.

Coating Compositions

The coating or overprint compositions comprise, in general, a wax emulsion. In some cases, the overprint compositions comprise a wax, an acrylic thickener and a solvent such as water. The wax coating is applied to a substrate after printing and fusing. The coating can be applied in the print production line or at a location downstream from printing.

After the wax coating is applied, it is dried. Drying can be accomplished by use of ambient air with or without the addition of minimal heat, for example, heating to from about 20 to about 90° C., or from about 25 to about 45° C., or from about 30 to about 38° C. A variety of heating methods are available including IR. Other heating methods using hot air are available.

Suitable wax based coatings comprise aqueous wax emulsions, including but not limited to aqueous polyolefin wax emulsions. The wax can be a polyethylene. In embodiments, the polyethylene wax has a melting point of from about 100 to about 150° C., or from about 125 to about 135° C. In embodiments, the aqueous wax emulsion has a viscosity of from about 1 to about 100 centipoise, or from about 5 to about 50 centipoise, or from about 10 to about 20 centipoise. In embodiments, the aqueous polyethylene wax emulsion has a pH of from about 9.0 to about 10.5, or from about 9.2 to about 9.8, or about 9.6. In embodiments, the aqueous polyethylene wax emulsion has a solids content of from about 20 to about 40, or from about 26 to about 34 percent by weight. Particle size of the polyethylene wax may range from 0.05 to 0.1 micron. The water content of the aqueous polyethylene emulsion may range from 66 to 74%. In some cases, an alcohol likely can be used in addition to water or in place of water for the continuous phase of the emulsion.

Non-limiting examples of suitable polyethylene waxes include JONCRYL WAX 26 & JONCRYL WAX 28. JONCRYL WAX 26 is a polyethylene wax from Johnson Polymer/BASF having a melting point of about 130° C., a particle size of from about 50 to about 100 nm, a loading of about 26 percent solids, a density of about 8.2 lbs/gal, a viscosity of about 10 centipoise, and a pH of about 9.8. The wax is a light translucent emulsion in water. JONCRYL WAX 28 is a polyethylene wax from Johnson Polymer/BASF and having a melting point of about 132° C., particle size of from about 80 to about 100 nm, a loading of about 34 percent solids, a density of about 8.3 lbs/gal, a viscosity of about 50 centipoise, and a pH of about 9.2. Other suitable waxes that are commercially available include Baker Petrolite Synthetic Polywax 725 and Baker Petrolite Synthetic Polywax 655.

The wax typically, but not necessarily, is present in the wet coating in an amount from about 10 to about 50 percent, or from about 15 to about 20 percent by weight. Suitable surfactants which may be present include Surfynol 504 (from Air Products), which includes a mixture of butanedioic acid, 1,4-bis(2-ethylhexyl) ester, sodium salt; NOVEC FC4432 (from 3M), which includes perfluorobutane sulfonates; and the like surfactants, and mixtures thereof. The surfactant is present in the wax coating in an amount of from about 0.1 to about 5 percent, or from about 0.5 to about 1 percent by weight. A surfactant is a surface-active agent that accumulates at the interface between 2 liquids and modifies their surface properties. Additives such as a UV fluorescing tag also can be included.

Other ingredients include water, which usually is present in the coating formulation from about 70 to 80 about percent by weight. Viscosity modifiers may also be present and include those which are alkali swellable, such as Acrysol ASE-60 (from Rohm & Haas), and associative thickeners such as Rheolate 255 (available from Elementis), and mixtures thereof. Humectants including but not limited to diethylene glycol can be added to the formulation to prevent spray nozzle clogging. Further details of suitable wax coatings are provide in commonly assigned U.S. patent application Ser. No. 11/523,283 filed Sep. 18, 2006, the contents of which are incorporated herein by reference in their entirety.

The overall coating composition typically has a non-Newtonian viscosity of from about 100 centipoise (low shear of $0.1s^{-1}$ at about 25 Deg. C.) to about 20000 centipoise (at high shear of $630s^{-1}$ at about 25 Deg. C.), or from about 100 centipoise to about 19400 centipoise at the time of application.

The ability of the composition to wet the substrate generally depends on its viscosity and surface tension. For example, if the surface tension is low, then the surface area covered by the composition will be high resulting in sufficient wetting of the substrate. In some embodiments, the composition formulations have a surface tension ranging from about 10 mN/m to about 50 mN/m, or from about 22 mN/m to about 34 mN/m when measured at 25 Deg. C. This surface tension may be adjusted to closely match that of the fuser oil (often about 22 mN/m) to ensure complete wetting of the document.

The composition can be applied to any type of xerographic substrate, such as paper, including wherein the substrate has a residue of fuser-oil (functionalized silicone oil). The substrate can contain additives including, but not limited to, anti-curl compounds, such as, for example, trimethylolpropane; biocides; humectants; chelating agents; and mixtures thereof; and any other optional additives well known in the xerographic art for enhancing the performance and/or value of the toner and/or substrate.

Coating Application Methods

The coating can be applied to selected portions of the substrate, and usually is applied across the entire surface of the substrate. One suitable application technique is spraying. For a document that has printing on two sides, both sides are coated. In some cases, the coating is applied to a thickness from about 0.5 to about 5 microns after drying, or from about 0.5 to about 2.0 microns after drying, or from about 0.5 to about 1.0 microns after drying. The document can be dried using known methods including air drying, infrared drying, and the like. The coating provides sufficient wetting to allow for a uniform coating over oil covered, fused toner documents. Drying can be accomplished by use of ambient air with or without the addition of minimal heat, for example, heating to from about 20 to about 90° C., or from about 25 to about 45° C., or from about 30 to about 38° C. There are many types of suitable IR dryers including IR heaters with a carbon twin quartz tube. The configuration (number of IR emitters) depends on the required process speed, formulation, etc.

Non-limiting examples of suitable spray techniques include an air propelled brush, an air atomized spray device, a hydraulic spray device, or an ultrasonic spray device. Material could also be applied via piezo ink-jet or similar technology. In embodiments, the air brush dispenses a wet mass per area of about 0.1 to about 5 mg/cm$^2$ of emulsion, or about 0.1 to about 3.5 mg/cm$^2$. The applicator is activated as the document passes under the nozzle (a fixed distance) at the process speed of the printing line to which the spray step is added. If the region to be sprayed is narrow, the spray nozzle can be turned at an angle or a mask can be used to cover portions of the document that do not need to be coated.

Conventional liquid film coating devices can be used for applying the overprint composition, including, but not limited to, roll coaters, rod coaters, blades, wire bars, dips, air-knives, curtain coaters, slide coaters, doctor-knives, screen coaters, gravure coaters, such as, for example, offset gravure coaters, slot coaters, and extrusion coaters, as long as the wax does not clog the coating equipment. Such devices can be used in their conventional manner, such as, for example, direct and reverse roll coating, blanket coating, dampener coating, curtain coating, lithographic coating, screen coating, and gravure coating.

The overprint compositions of embodiments may be applied over toner-based images and substrates that have residual fuser oil or residual release oil present on the print. These residual oils may be silicon oils, such as polydimethylesiloxanes, and/or functionalized silicon oils, such as amino-functionalized PDMS oils and mercapto-functionalized PDMS oils. In some embodiments, these residual oils cover 5% to 100% of the area of the toner-based image and substrate. In embodiments, these residual oils cover the toner-based image and substrate at levels over from 0 to 50 μg/cm$^2$. The surface energy in areas covered by these residual oils may be as low as 15 mN/m.

One embodiment is the combination of air propelled brush with an aqueous wax emulsion (Table 1) sprayed on an area of a fused iGen3 print. The system is run in-line to an iGen3 digital production press, post-fusing step. The coating is applied as a thin film of about 0.1 to 3.5 mg/cm$^2$ wet, and the mass of the coating is low enough to be almost undetectable after drying.

The composition can be applied to the substrate at any suitable time after image formation and can be applied over the entire substrate, the entire image, parts of the substrate, or parts of the image. Preferably, the toner-based image on the substrate has been previously prepared by any suitable xerographic process comprising, for example, generating an electrostatic image, developing the electrostatic image with toner, and transferring the developed toner-based image to a substrate, or modifications thereof, well-known in the art of xerography.

More specifically, methods for generating images coated with the overprint compositions disclosed herein comprise: generating an electrostatic latent image on a photoconductive imaging member, developing the latent image with toner, transferring the developed electrostatic image to a substrate, coating the substrate or parts thereof and/or image or parts thereof with an overprint composition, and curing the composition. Development of the image can be achieved by a number of methods known in the art, such as, for example, cascade, touchdown, powder cloud, magnetic brush, and the like. Transfer of the developed image to the substrate can be by any method, including, but not limited to, those making use of a corotron or a biased roll. The fixing step can be performed by means of any suitable method, such as, for example, flash fusing, heat fusing, pressure fusing, vapor fusing, and the like. Suitable imaging methods, devices, and systems are known in the art and include, but are not limited to, those described in U.S. Pat. Nos. 4,585,884, 4,584,253, 4,563,408, 4,265,990, 6,180,308, 6,212,347, 6,187,499, 5,966,570, 5,627,002, 5,366,840; 5,346,795, 5,223,368, and 5,826,147, the entire disclosures of which are incorporated herein by reference.

As indicated above, the aqueous wax emulsion creates a film which imparts heat, humidity, and/or pressure resistance to media having underlying images printed with toner.

Toners Used in Printing Underlying Images

The toner resins upon which the coating is deposited are generally low melt toners, as an overcoat is not usually required to impart heat and humidity resistance to high melt toners. The low melt toners typically have a surface glass transition temperature in the range of about 50° C. to about 70° C., or about 50° C. to about 62° C. The toner can be a partially crosslinked unsaturated resin such as unsaturated polyester prepared by crosslinking a linear unsaturated resin (hereinafter called base resin), such as linear unsaturated polyester resin, in embodiments, with a chemical initiator, in a melt mixing device such as, for example, an extruder at high temperature (e.g., above the melting temperature of the resin, and more specifically, up to about 150° C. above that melting temperature) and under high shear. Also, the toner resin possesses, for example, a weight fraction of the microgel (gel content) in the resin mixture of from about 0.001 to about 50 weight percent, from about 1 to about 20 weight percent, or about 1 to about 10 weight percent, or from about 2 to about 9 weight percent. The linear portion is comprised of base resin, more specifically unsaturated polyester, in the range of from about 50 to about 99.999 percent by weight of the toner resin, or from about 80 to about 98 percent by weight of the toner resin. The linear portion of the resin may comprise low molecular weight reactive base resin that did not crosslink during the crosslinking reaction, more specifically unsaturated polyester resin.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, or from about 3,000 to about 8,000. The weight average molecular weight ($M_w$) of the linear portion is from, for example, about 2,000 to about 40,000, or from about 5,000 to about 20,000. The weight average molecular weight of the gel portions is greater than 1,000,000. The molecular weight distribution ($M_w/M_n$) of the linear portion is from about 1.5 to about 6, or from about 1.8 to about 4. The onset glass transition temperature ($T_g$) of the linear portion as measured by differential scanning calorimetry (DSC) is from about 50° C. to about 70° C.

Moreover, the binder resin, especially the crosslinked polyesters, can provide a low melt toner with a minimum fix temperature of from about 100° C. to about 200° C., or from about 100° C. to about 160° C., or from about 110° C. to about 140° C.; provide the low melt toner with a wide fusing latitude to minimize or prevent offset of the toner onto the fuser roll;

and maintain high toner pulverization efficiencies. The toner resins and thus toners, show minimized or substantially no vinyl or document offset.

Examples of unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. An example of a suitable polyester is poly(propoxylated bisphenol A fumarate).

In embodiments, the toner binder resin is generated by the melt extrusion of (a) linear propoxylated bisphenol A fumarate resin, and (b) crosslinked by reactive extrusion of the linear resin with the resulting extrudate comprising a resin with an overall gel content of from about 2 to about 9 weight percent. Linear propoxylated bisphenol A fumarate resin is available under the trade name SPAR II™ from Resana S/A Industrias Quimicas, Sao Paulo Brazil, or as NEOXYL P2294™ or P2297™ from DSM Polymer, Geleen, The Netherlands, for example.

Chemical initiators, such as, for example, organic peroxides or azo-compounds, can be used for the preparation of the crosslinked toner resins.

The low melt toners and toner resins may be prepared by a reactive melt mixing process wherein reactive resins are partially crosslinked. For example, low melt toner resins may be fabricated by a reactive melt mixing process comprising (1) melting reactive base resin, thereby forming a polymer melt, in a melt mixing device; (2) initiating crosslinking of the polymer melt, more specifically with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed and broken down during shearing and mixing, and well distributed in the polymer melt; (5) optionally devolatilizing the polymer melt to remove any effluent volatiles; and (6) optionally adding additional linear base resin after the crosslinking in order to achieve the desired level of gel content in the end resin. The high temperature reactive melt mixing process allows for very fast crosslinking which enables the production of substantially only microgel particles, and the high shear of the process prevents undue growth of the microgels and enables the microgel particles to be uniformly distributed in the resin.

A reactive melt mixing process is, for example, a process wherein chemical reactions can be affected on the polymer in the melt phase in a melt-mixing device, such as an extruder. In preparing the toner resins, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. As the amount of crosslinking desired is achieved, the reaction products can be quickly removed from the reaction chamber.

The resin is present in the toner in an amount of from about 40 to about 98 percent by weight, or from about 70 to about 98 percent by weight. The resin can be melt blended or mixed with a colorant, charge carrier additives, surfactants, emulsifiers, pigment dispersants, flow additives, embrittling agents, and the like. The resultant product can then be pulverized by known methods, such as milling, to form the desired toner particles.

Waxes with, for example, a low molecular weight $M_w$ of from about 1,000 to about 10,000, such as polyethylene, polypropylene, and paraffin waxes, can be included in, or on the toner compositions as, for example, fusing release agents.

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites M08029™, M08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI-74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60 percent by weight, or from about 2 to about 9 percent by weight for color toner, and about 3 to about 60 percent by weight for black toner.

The toner composition can be prepared by a number of known methods including melt blending the toner resin particles, and pigment particles or colorants, followed by mechanical attrition. Other methods include those well known in the art such as spray drying, melt dispersion, dispersion polymerization, suspension polymerization, extrusion, and emulsion/aggregation processes.

The resulting toner particles can then be formulated into a developer composition. The toner particles can be mixed with carrier particles to achieve a two-component developer composition.

Referring to the drawings and first to FIG. 1, a printed and coated document is shown and is generally designated as 10. Thicknesses of the layers are exaggerated for illustrative purposes. The document includes a substrate 12 with a set 14 of images printed thereon using a low melt temperature toner. A coating 16 is formed over substrate 12, including over the image set 14. The coating provides the image with very low toner offset when exposed to heat, humidity and/or pressure.

Figure 2:
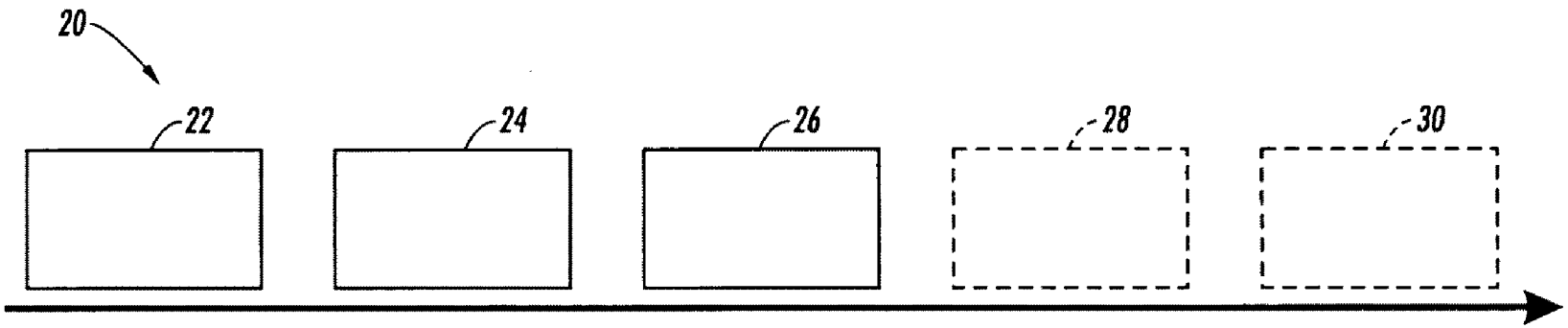
FIG. 2 schematically shows a printing system according to certain embodiments.

FIG. 2 shows a printing system according to one embodiment, generally designated as 20. The substrates move in the direction shown by the arrow. A substrate is printed with toner in a printer 22. The printed image is coated using a coater 24, and the coating is dried at a drying station 26. Optionally, the printed and coated substrate is collated as part of a multi-page document at a collation station 28 and is bound at a binding station 30.

Figure 3:
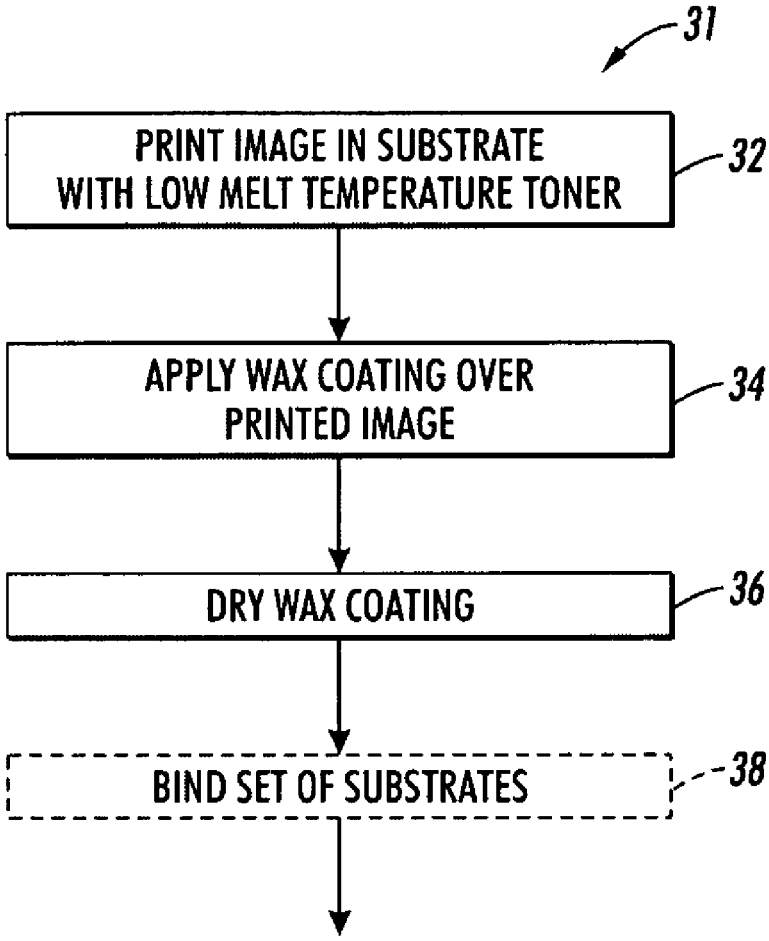
FIG. 3 is a flow diagram illustrating a coating method.

Referring now to FIG. 3, a flow chart for the method of one embodiment is shown. The overall process is designated as 31. First, a substrate is printed at 32 with a toner based image using a low melt temperature toner. The image is fused as part of the printing process. Next, a wax coating is sprayed or otherwise applied at 34 over the portion of the substrate containing the printed image. Spraying usually takes place in-line with the printing process. The coating usually, but not necessarily, covers the entire front surface of a one-sided print, and the entire front and back surfaces of a two-sided print. Finally, the coating is dried at 36 to evaporate the water or other solvent in the coating system. Drying can take place at an elevated temperature or at ambient conditions. In some cases, after drying the substrate is combined with other substrates in a binding process at 38 to form a multi-page, bound document.

The following Examples are intended to illustrate and not limit the scope herein.

EXAMPLE 1

Images were printed on Stora Enso 67 gsm (45#) paper stock with a low melt temperature Xerox toner having a bulk $T_g$ of about 56° C. using an iGen3 digital production press. After fusing, the entire front surface of each print in a first set was coated with 0.0046 g/cm2 of a wax emulsion having Formulation 1 shown below. The coating was dried at ambient conditions. Heated drying could have been used to reduce the drying time. A second set of prints remained uncoated as a control.

Formulation 1: 2.5 wt % Acrysol ASE-60 (Rohm & Haas), a proprietary alkali swellable, crosslinked, acrylic thickener (50% solution); and 97.5 wt % Jonwax 26 (BASF Johnson Polymer), a proprietary polyethylene wax emulsion having about 20-30% solids in water.

The printed and coated paper stock as well as the control prints were then subjected to the Audi Blocking Thermal Cycling Test between −40° C. to +70° C. over 24 hours at 4g/cm$^2$ pressure. The relative humidity was 50% at temperatures of +1 to 70° C. and 0% at sub-freezing temperatures. Details of the test conditions are shown below on Table 1. Where two temperatures are shown on a single line, the temperature was increased or decreased within the stated range over the time period indicated.

TABLE 1

| Blocking Thermal Cycling Test | |
|---|---|
| 23° C. (Room Temperature) to 70° C. | 2 hours |
| Hold @ 70° C. | 4 hours |
| 70° C. to −40° C. | 2 hours |
| Hold @ −40° C. | 4 hours |
| −40° C. to 70° C. | 2 hours |
| Hold @ 70° C. | 4 hours |
| 70° C. to −40° C. | 2 hours |
| Hold @ −40° C. | 4 hours |
| −40° C. to 23° C. (Room Temperature) | 2 hours |

Upon removal from the cycling test, samples were peeled apart and damage to the images was characterized via image analysis. The average area of 'white' pixels detected at a specific threshold indicated the amount of paper damage done by toner offset to the area of interest.

Figure 4:
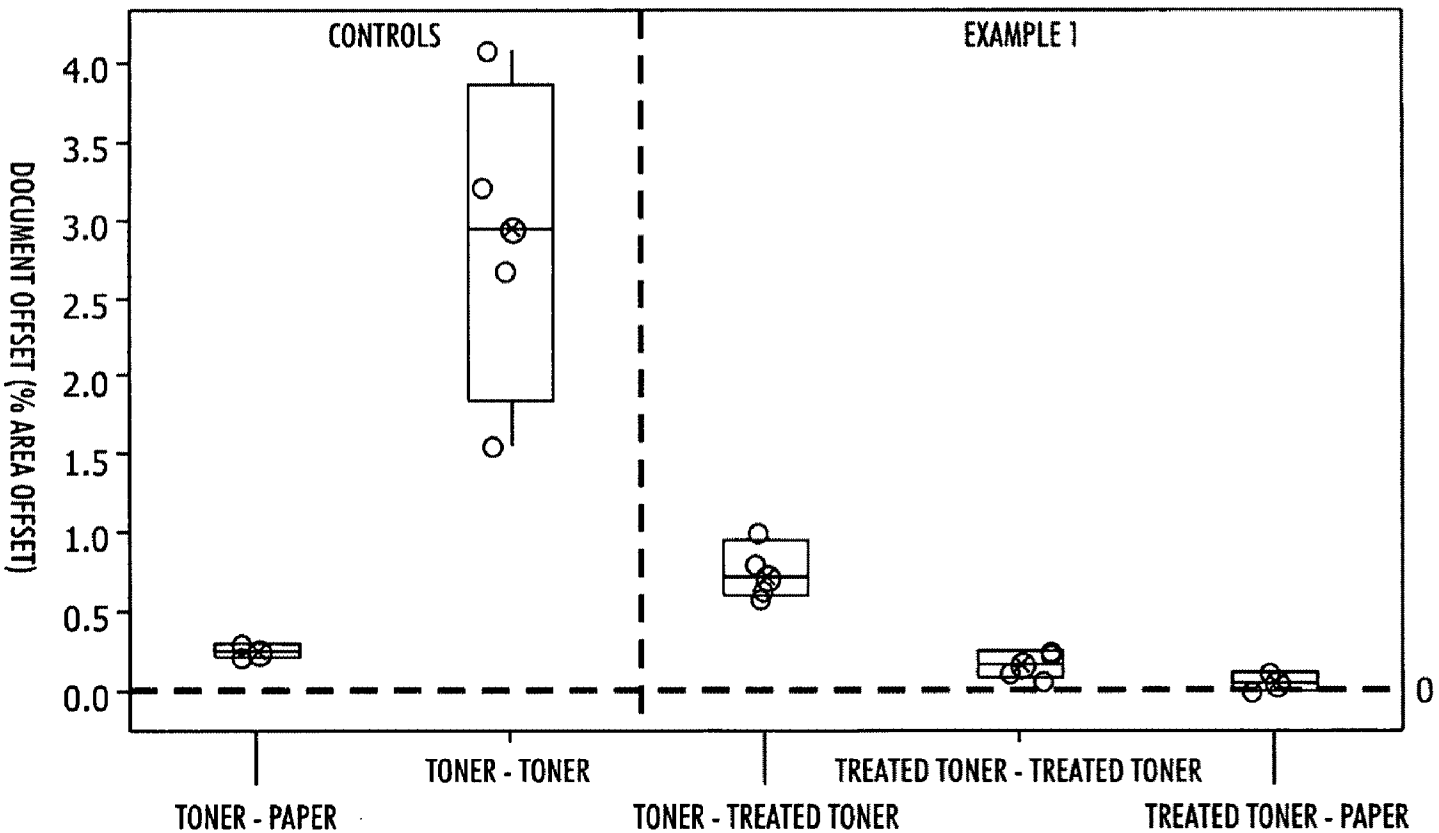
FIG. 4 is a box plot of document offset for prints that are coated in accordance with the disclosed embodiments and then subjected to the Blocking Test.

FIG. 4 shows several scenarios resulting in possible toner offset that were examined. The uncoated control samples were tested for Toner—Toner blocking and Toner—Paper blocking. The coated samples were tested using the following pair-combinations: Treated (Coated) Toner to (Untreated) Toner, Treated Toner to Paper, and Treated Toner to Treated Toner. In all cases testing was done at a location on the document at which the wax coating was on top of a fused toner image.

When the coating was used, there was significant improvement in the case of Toner—Toner, even if only one of the two images was treated (i.e. (Untreated) Toner to Treated Toner case). However, if both toner images were treated (Treated Toner to Treated Toner) there was nearly perfect release with no damage. Furthermore, Toner to paper also improved when the Toner was treated (Treated Toner to Paper), whereas in this case the blank paper did not need to be treated.

The bars on FIG. 4 show ranges/averages of several data points analyzed to get the % white area (the area where offset occurred). To pass the Blocking Thermal Cycling test, a % area offset of no more than 1% is required. The data on FIG. 4 show that prints coated with an aqueous wax emulsion pass the Blocking Thermal Cycling Test, with less than 0.5% offset, whereas prints with no coating fail the toner-toner test.

Figure 5:
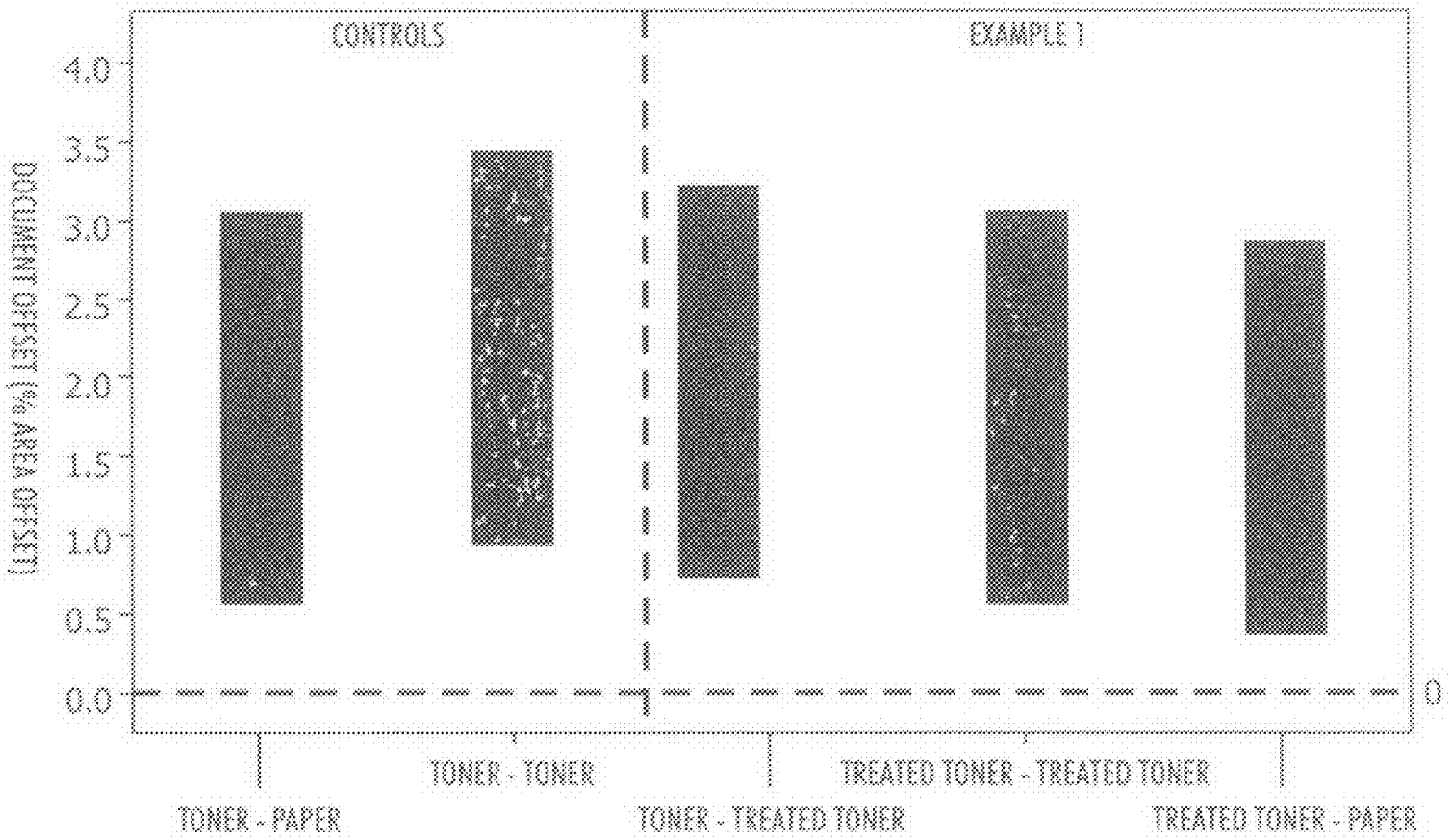
FIG. 5 compares the offset of toner-based prints and paper with and without the wax coating.

FIG. 5 shows photos (300 dpi scan) of sample images after the Blocking Thermal Cycling Test. A difference is clearly visible between the Toner to Toner control and the Treated Toner samples. Treated Toner to Treated Toner samples, on which a wax coating was applied to both images that were pressed against one another, and Treated Toner to Paper samples showed essentially no offset of toner.

PROPHETIC EXAMPLE 2

The procedure of Example 1 is repeated for 30 documents, and each document is printed and coated on both sides. The set of 30 documents is then bound to form a book. When the book is kept in a glove compartment of a car at which the book reaches a temperature of 60° C. for a period of 24 hours, the toner offset area is less than 1%.

The embodiments disclosed herein enable prints to be used for automobile manuals, books, mailers, bound reports, etc. and other applications in which the prints must survive exposure to elevated temperature, pressure and/or humidity conditions.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims. Unless specifically defined in a specific claim itself, steps or components of the invention should not be implied or imported from any above example as limitations to any particular order, number, position, size, shape, angle, color, or material.

What is claimed is:

1. A method comprising:

printing an image comprising a low melt temperature toner on a substrate, coating the printed image with a wax emulsion having a thickness of about 0.5 to about 5 microns, and drying the wax emulsion to form a wax coating, the dried coating substantially preventing toner offset of the printed image at temperatures up to at least 50° C. at up to at least 50% relative humidity.

2. The method of claim 1, wherein the coating is sprayed with an air propelled brush.

3. The method of claim 1, wherein the coating is sprayed in a wet mass of about 0.1 to about 5 mg/cm2.

4. The method of claim 1, wherein the printing, coating and drying take place within the same production line.

5. The method of claim 4, wherein, at the time of application, the coating has a viscosity of from about 100 cP to about 20000 cP at about 25° C. (high shear and low shear, respectively) and a surface tension of from about 22 to about 34 mN/m at about 25° C.

6. The method of claim 1, wherein, at the time of application, the coating has a viscosity of from about 100 cP to about 20000 cP at about 25° C. (high shear and low shear, respectively) and a surface tension of from about 22 to about 34 mN/m at about 25° C.

7. The method of claim 1, wherein the substrate has opposed first and second sides, each of which has a coated image thereon, further comprising including the substrate in a collated set of substrates and binding the collated set.

8. The method of claim 1, wherein printing includes generating an electrostatic latent image on a photoconductive imaging member, developing the latent image with the toner, and transferring the developed electrostatic image to the substrate.

9. The method of claim 1, wherein the wax coating has a dry thickness of about 0.5 to about 2 microns.

10. The method of claim 1, wherein the wax coating is applied in a thickness sufficient to prevent toner offset at temperatures up to at least 70° C.

11. The method of claim 1, wherein the coated image has an offset area of no more than 1% when subjected to the Blocking Thermal Cycling Test.

12. The method of claim 1, wherein the coated image has an offset area of no more than 0.5% when subjected to the Blocking Thermal Cycling Test.

13. The method of claim 1, wherein the wax emulsion comprises a polyethylene.

14. The method of claim 1, wherein the wax emulsion comprises a wax, an emulsifier and water.

15. The method of claim 13, wherein the wax emulsion further comprises at least one of a surfactant, viscosity modifier, thickener, and humectant.

16. The method of claim 1, further comprising fusing the printed image before coating.

17. The method of claim 16, wherein the substrate has residual fuser oil thereon, and the coating is applied over the residual fuser oil.

18. The method of claim 1, wherein the wax emulsion comprises a polyolefin.

19. The method of claim 1, wherein at the time of coating the wax emulsion has a surface tension in the range of about 10 mN/m to about 50 mN/m as measured at 25 Deg. C.

20. The method of claim 1, wherein the dried coating substantially prevents toner offset of the printed image at temperatures up to at least 70° C. at up to at least 50% relative humidity.

* * * * *